US012680421B2

(12) United States Patent
Abou-Sayed et al.

(10) Patent No.: US 12,680,421 B2
(45) Date of Patent: Jul. 14, 2026

(54) SEQUESTRATION OF BIO-SLUDGE IN A SUBTERRANEAN FORMATION

(71) Applicant: Advantek Waste Management Services, LLC, Houston, TX (US)

(72) Inventors: Omar Abou-Sayed, Houston, TX (US); Ibrahim Mohamed, Houston, TX (US); Yashesh Panchal, Houston, TX (US); Ahmed Abou-Sayed, Houston, TX (US); Jay Cecil, Houston, TX (US); Steve Pangburn, Houston, TX (US)

(73) Assignee: Advantek Waste Management Services, LLC, Houston, TX (US)

( * ) Notice: Subject to any disclaimer, the term of this patent is extended or adjusted under 35 U.S.C. 154(b) by 0 days.

(21) Appl. No.: 18/866,520

(22) PCT Filed: Mar. 14, 2024

(86) PCT No.: PCT/US2024/020024
§ 371 (c)(1),
(2) Date: Nov. 15, 2024

(87) PCT Pub. No.: WO2024/196715
PCT Pub. Date: Sep. 26, 2024

(65) Prior Publication Data

US 2025/0354461 A1 Nov. 20, 2025

Related U.S. Application Data

(60) Provisional application No. 63/493,975, filed on Apr. 3, 2023, provisional application No. 63/490,923, filed on Mar. 17, 2023.

(51) Int. Cl.
*E21B 41/00* (2006.01)
*E21B 43/26* (2006.01)

(52) U.S. Cl.
CPC ..... *E21B 41/0064* (2013.01); *E21B 43/26* (2013.01)

(58) Field of Classification Search
CPC ..... C09K 8/68; C09K 8/602; C09K 8/665; C09K 8/845; C09K 8/86; E21B 43/26; E21B 43/16
See application file for complete search history.

(56) References Cited

U.S. PATENT DOCUMENTS

| | | | | |
|---|---|---|---|---|
| 7,891,114 | B2 * | 2/2011 | Lasonde | C05F 3/00 34/337 |
| 10,633,953 | B2 | 4/2020 | Abou-Sayed | |
| 10,975,669 | B2 | 4/2021 | El Kholy | |
| 12,281,542 | B2 | 4/2025 | Abou-Sayed | |

(Continued)

FOREIGN PATENT DOCUMENTS

CN 113931626 A 1/2022

OTHER PUBLICATIONS

International Search Report and Written Opinion, PCT/US2024/020024, dated Jul. 2, 2024. 6 pages.

(Continued)

*Primary Examiner* — Silvana C Runyan
(74) *Attorney, Agent, or Firm* — Peter V. Schroeder; Booth Albanesi Schroeder PLLC

(57) ABSTRACT

A method for sequestrating carbon-bearing materials in a subterranean formation by injecting a bio-slurry and determining the carbon emission effects of the injection process.

10 Claims, 2 Drawing Sheets

(56) References Cited

U.S. PATENT DOCUMENTS

| | | | | |
|---|---|---|---|---|
| 12,460,512 | B1 | 11/2025 | Abou-Sayed | |
| 2010/0230830 | A1* | 9/2010 | Farsad | B01D 53/78 261/111 |
| 2013/0043163 | A1* | 2/2013 | Keith | G06Q 50/00 166/402 |
| 2016/0222774 | A1* | 8/2016 | Rhodes | C10G 1/04 |
| 2017/0218740 | A1* | 8/2017 | Pichach | E21B 43/16 |
| 2020/0284945 | A1 | 9/2020 | Kahn et al. | |
| 2021/0363860 | A1* | 11/2021 | Rio | E21B 41/0064 |
| 2022/0372847 | A1 | 11/2022 | Meehan et al. | |
| 2023/0160283 | A1 | 5/2023 | Meehan | |
| 2024/0167365 | A1 | 5/2024 | Groenenboom | |

OTHER PUBLICATIONS

Brazilian Office Action (Portuguese) Nov. 7, 2025; English translation attached (no verification of accuracy).
Brazilian Office Action (Portuguese) Jul. 11, 2025; English translation attached (no verification of accuracy).

* cited by examiner

SEQUESTRATION OF BIO-SLUDGE IN A SUBTERRANEAN FORMATION

CROSS-REFERENCED APPLICATIONS

This is a U.S. Non-Provisional application for patent and claims priority to U.S. Provisional application Nos. 63/490,923, filed Mar. 17, 2023, and 63/493,975, filed Apr. 3, 2024, both of which are incorporated herein by reference for all purposes.

FIELD

The disclosed methods and apparatus generally relate to methods for sequestering carbon-bearing materials in a subterranean formation.

BRIEF DESCRIPTION OF THE DRAWING

Drawings of the preferred embodiments of the present disclosure are attached hereto so that the embodiments of the present disclosure may be better and more fully understood.

DETAILED DESCRIPTION OF CERTAIN EMBODIMENTS

Figure 1:
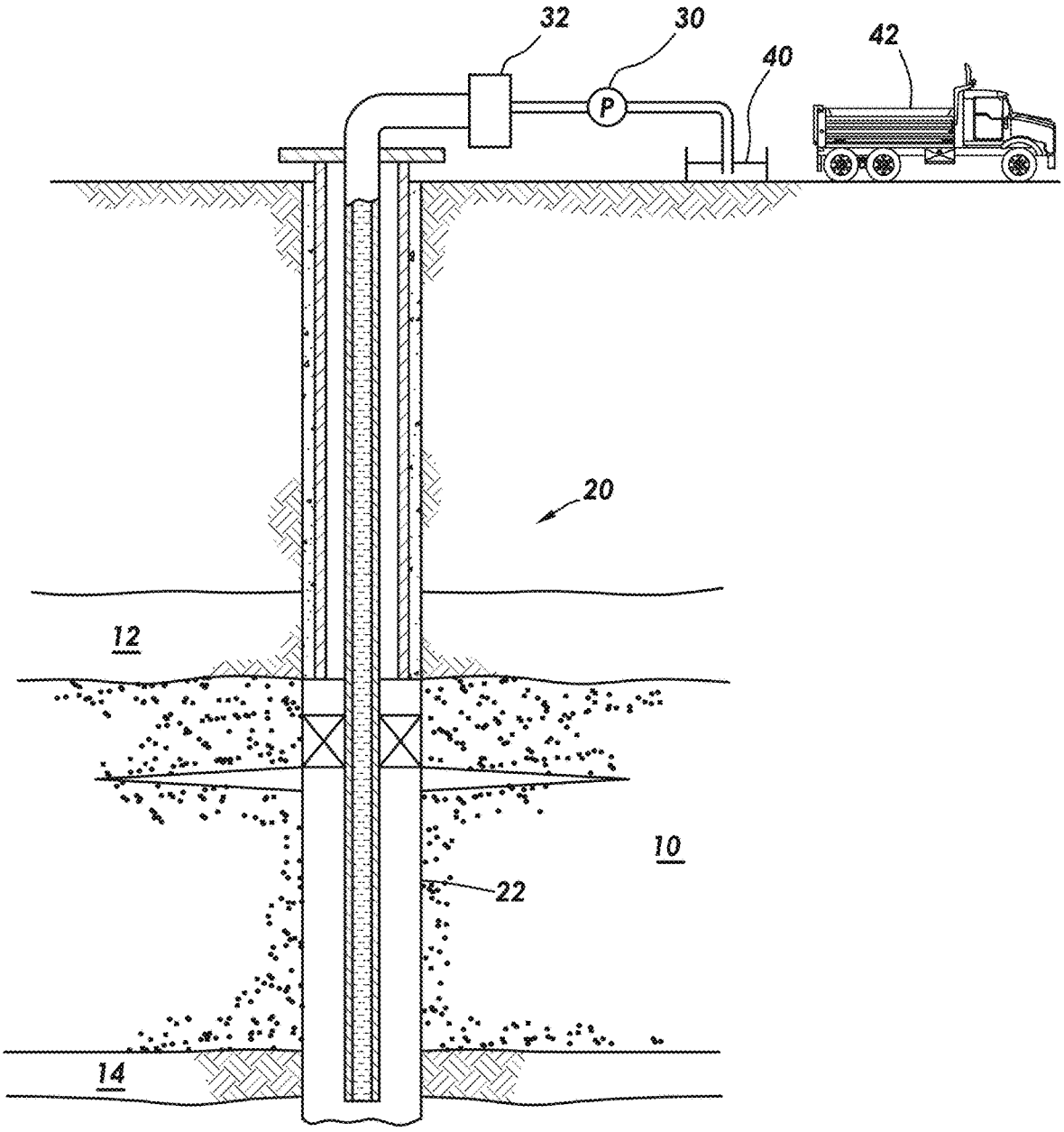
FIG. 1 is a schematic of an exemplary injection well disposal operation and surface processing according to aspects of the disclosure.

It is known to inject slurry waste, such as organic waste or drilling waste into a subterranean formation for long-term storage or sequestration of the waste. Slurry waste is often injected into the formations during multiple injections, often in batches. Often such injection procedures are fracturing injections, that is, where the slurry is pumped into the formation above fracturing pressure, thereby fracturing ("fracking") the formation.

In an effort to reduce the effects of global climate change, communities are seeking ways to reduce carbon release into the environment and to reduce the total carbon currently present in the environment. Some governments have enacted laws providing for carbon taxes based on the production or release of carbon or carbon-bearing materials, including carbon credits for entities effectively reducing carbon creation or release. Carbon capture processes seek to earn carbon credits by reducing the carbon that would otherwise be released or created. This requires a determination of how much carbon is sequestered, permanently stored, or destroyed by such processes. Carbon credit accounting makes such a determination, taking into account carbon captured by a process, carbon emissions due to the process, carbon lost during the process, etc. Carbon accounting must also calculate the amount of carbon content in a stored, sequestered or disposed material.

Carbon-Bearing Waste, Bio-Sludge

One source of carbon is bio-sludge, which is high in carbon content, has little or no commercial value, and is prime for long term or permanent storage or sequestration, namely via geological permanent storage in subterranean formations by injection well operations.

Carbon-bearing waste includes a waste spectrum from micro-organisms used in carbon-capturing technology (e.g, algae), growing aquatic plants like duckweeds, food wastes, animal waste, human waste, forestry waste, and methanotrophic bacteria. Duckweed, for example, may have the potential to take in up to ten times as much carbon per acre as a healthy forest.

Bio-sludge waste also includes residual mass from oil, protein, and fiber extraction from organisms, plants, seeds, and fruit. In the process typically used to extract oil from vegetation, for use as food, for example, the vegetation is pulped (e.g., crushing soybeans) and then typically a solvent is used to extract the oil from the vegetative pulp. This leaves a residual pulp (e.g., soybean meal, olive oil cake and related pulps). These remainder vegetative pulps are carbon-bearing waste which are or can be processed to make bio-sludge.

Bio-sludge also includes residual sludge from food processing industries, restaurants and the like, which contain starches, sugars and other similar dissolved solids. Waste can come from a primary level (farm to retail), retail level (e.g., grocery stores), and consumer level (food consumed at home and restaurants). Fruit and vegetable industrial solid waste include items removed from fruits and vegetables during cleaning, processing, cooking, and/or packaging. These items may include leaves, peels, pomace, skins, rinds, cores, pits, pulp, stems, seeds, twigs, and spoiled fruits and vegetables. Solid waste from the meat processing and rendering sector is comprised primarily of slaughterhouse waste. Wastewater from a slaughterhouse can contain blood, manure, hair, fat, feathers and bones (manure is a solid waste product of the meat sector, but is not discussed in this analysis). Spent brewer's grain and brewer's yeast are the two primary solid wastes (by-products) of the beer brewing process.

Bio-sludge waste can also include or be made from prokaryotes and eukaryotes, bacteria, fungi, phytoplankton, diatoms, dinoflagellates and similar organisms.

Forestry and agriculture wastes may include bio-sludge, or be used to create bio-sludge, such as saw dust, agricultural residues like corn stover, husks, chaff, palm, bio-oil from processing of ag and forestry biomass using hydrothermal liquefaction or pyrolysis, biochar from processing of ag and forestry biomass using hydrothermal liquefaction or pyrolysis, paper and pulp sludge, bio-oil and biochar.

Preparation of Bio-Sludge Slurry

The disclosure includes injection of bio-sludge in a slurry form into a subterranean formation using fracturing injection.

Bio-sludge will be prepared into an injectable slurry using combinations of the bio-waste and bio-sludge mentioned herein, by mixing with an available water supply. The water supply can be HPE, brine, freshwater, saltwater, etc., based on the location of the operation. The process includes preparation of a slurry suitable for injection, or fracturing injection in an injection well. Such processes may include filtering, grinding or other preparation or removal of unsuitable solids, for example. Fluid weight and viscosity may be altered through the addition of additives, removal of material, etc. Further, the process can include introducing methanotrophic bacteria in the pre-injection tanks to consume or reduce the methane produced in the bio-sludge or bio-sludge slurry due to decomposition of organic matter.

These materials (except bio-oil) need to be slurrified, which includes particle size degradation or oversized particle removal at a minimum, and mixing/blending with a carrier fluid. It can also include viscosifying the final fluid, adding chemicals to change pH or to accelerate or decelerate microbial action, etc.

Injection of Bio-Sludge into a Subterranean Zone

The prepared slurry is injected into a subterranean zone specifically chosen for the purpose. For injection of bio-sludge slurry, the slurry is injected into a formation zone made of porous rock or the like, and the process can include fracturing injection. For some bio-sludge waste, such as biochar and the like, the bio-sludge can be sequestered into an open subterranean cavern located in a suitable zone. The cavern is typically filled with brine or similar liquid. Unless stated otherwise herein, a subterranean zone does not include a cavern, but rather is made up of rock.

Fracturing injection is a critical step for a solid-bearing slurry to be injected into a subterranean formation. Fracturing injection of a slurry is done at above fracture pressure for the formation. The formation must be isolated, such as by impermeable strata above and below the target zone, such that the injected slurry does not encroach other zones. Fracturing injection is known in the art and not described in detail here. The injection of solid carbon-bearing wastes in the form of a slurry into a subterranean formation must be done above the fracturing gradient of the formation.

The solids in the slurry make injection without fracturing infeasible as the non-fractured pore space is not large enough to inject the solids particles. Consequently, fracturing injection is required as it provides large enough fractures and cracks for the injection and retention of the solids particles. The Solids content of the slurry is below 50% by volume, with particle sizes of less than 1000 microns, or preferably less than 500 microns, or more preferably less than 300 microns. The slurry must be fluidly viscous as it must be injected at a relatively high flow rate.

FIG. 1 is a schematic of an exemplary injection well operation and surface processing according to aspects of the disclosure. An injection well 20 has a wellbore 22 extending through the targeted zone 10 or zones. An injection well 20 may be a converted production well in a formation or zone depleted of its hydrocarbons or a dedicated disposal or injection well. The wellbore 22 is typically cased along at least a portion of its depth. One or more tubulars can be positioned in the wellbore and injection can occur through the tubulars or along the annulus between the wellbore and tubular. Downhole tools, as is known in the art, can be employed during injection and hydraulic fracturing operations such as packers, seals, valves, screens, and measuring and sensing equipment (such as pressure sensors, bottom hole sensors, etc.). Measurement equipment can sense, record, and transmit data representative of temperature pressure, flow rate, acidity, etc., as measured at the surface, in the wellbore, at the bottom of the hole, etc. At issue here are pressure sensors for measuring or allowing calculation of formation pressure after shut-in of the well after waste fluid injection operations. Measurements may be made at downhole, wellbore, wellhead locations.

Pumping equipment, such as an injection pump 30 is positioned at the wellhead to pump waste fluids into the wellbore under pressure. Injectate, such as bio-slurry, is pumped into the wellbore and into the target subterranean zone 10. The target zone 10 is bounded above by zone 12 and below by zone 14 which do not allow migration of injected slurry or materials out of zone 10. In some embodiments, the injectate is pumped under pressure above the fracture gradient resulting in fractures in the zone. In other embodiments, the zone includes a cavern-open space often filled with fluid such as brine- and the injectate is injected into the cavern. Associated operational valving, controls, and safety valves 32 are known in the art and are represented here by a single block.

As discussed elsewhere herein, bio-sludge containing material is transported using a transporting system 42 to an injection site, the bio-sludge containing material having a solids content. The transport here is represented by a tanker truck although obviously the transport can be by other means known in the art such as pipeline, train or the like. A tank 40 is seen as representative of a multitude of surface equipment for treating and storing the bio-sludge containing material. Persons of skill in the art will understand that surface equipment can include tanks, pumps, grinders, filters, weirs, centrifuges, and various other equipment. The surface equipment can be used to perform the various tasks described elsewhere herein in preparing the transported materials into injectate, bio-slurry and the like.

Mixed-Density Bio-Solids

It has become advantageous, for environmental concerns, to reduce free carbon in the environment, and to provide processes for creating carbon credits from disposal of carbon, to inject or emplace carbon-bearing materials in subterranean formations, either in open subterranean caverns or by injection into porous and permeable formation zones. Some suitable bio-sludge for sequestration is of mixed-density, that is, some of the solids of the bio-sludge tend to float in a carrier fluid while other solids of the bio-sludge material tends to sink in a carrier fluid. Alternately, the tendency to float or sink can be measured against a fluid resident in or expected to be resident in the subterranean zone of sequestration. Such mixed-density bio-sludge includes biochar, biochar from processing agricultural and forestry biomass, biochar from processing of ag and forestry biomass using hydrothermal liquefaction or pyrolysis, forestry waste, agricultural residues, corn stover, husks, chaff, and the like. The discussion below is specific to the treatment of biochar, but persons of skill will understand that the suggested processes can be used on other mixed-density bio-sludge materials.

Biochar is a carbon-bearing material created as waste from other industrial processes. One method of carbon sequestration is to place biochar into a subterranean cavern. The subterranean caverns are typically substantially filled with salt water or brine. The biochar is injected into the subterranean cavern through a subterranean wellbore, typically in slurry form suitable for pumping into the wellbore to the cavern.

However, when emplacing biochar into a subterranean cavern, some biochar tends to float to the surface of the brine in the cavern. Some of the biochar sinks in the saturated salt brine. The biochar is generally porous, and the pores may be filled with air, syngas, CO2, fresh water or other relatively low-density material. When this is the case, the biochar may then float in the relatively denser brine.

Degrading the biochar, prior to injection, promotes sinking of the biochar. For example, the biochar can be degraded by grinding or milling the biochar. Grinding or milling breaks open the pores in the biochar. The lower density material can then escape (e.g., as air, CO2, etc.) or be displaced by the saturated brine, which promotes the solid biochar sinking. The escaped gasses can be captured and processed for sequestration if desired.

Consequently, the biochar should be degraded prior to or as part of preparing the biochar slurry for injection. In an embodiment, the biochar is ground or milled to be small enough to sink. In an embodiment, the biochar is submerged in a weir tank or the like, which separates out the floating biochar particles as they pass over the weir wall into a dedicated chamber. The separated floating biochar can then be ground, milled or otherwise processed. In an embodiment, instead of a weir tank, a hydro-cyclone, centrifuge or other similar equipment is used to separate the biochar by relative density before degradation.

Tracking Carbon Emissions

The injection of the bio-sludge slurry results in the sequestration of carbon in a subterranean formation. However, the carbon content of the injected slurry must be determined and verified for use in a carbon credit system.

Generally, the steps for determining carbon credits, are to determine the net carbon dioxide removal from the environment due to the carbon sequestration or other remedial process. Various governmental and non-governmental organizations provide general guidelines regarding standards for calculating carbon content. The accepted formula for determining carbon credits is: Net CO2 removal (kgCO2e)=C captured–CO2 emissions from the project–CO2 losses.

To determine the CO2 emissions from a project, calculate all emissions associated with each of the processing and transport steps. These can include emissions related to trucking material to the sludge preparation or injection site, power used in processing and injecting the bio-sludge slurry, emissions used in making any consumables associated with processing.

To determine CO2 losses, it is necessary to track and calculate carbon emissions that arise elsewhere in the economy as a result of sequestering the bio-sludge materials. Losses could include leakage from the process, like methane leaks from processing, or emissions increases in response to injection the carbon sources, like emissions from making petroleum derived fertilizers bought by a farmer to replace injected manure.

Measuring the Carbon Content of the Bio-Sludge to be Sequestered

To determine "CO2 captured," it is necessary to determine the CO2 content percentage of the carbon-bearing substance. In the case of bio-sludge, the carbon content in the bio-sludge, or prepared bio-sludge slurry, can be measured using following formula:

(Mass of volatilizable Carbon+mass of volatilizable N molecules)/(Total mass of sample)

One way to get the $CO_2$ produced is using Method 1684, as used by U.S. EPA. This method is applicable to the determination of total solids and the fixed and volatile fractions in such solid and semisolid samples as soils, sediments, biosolids (municipal sewage sludge), sludge separated from water and wastewater treatment processes, and sludge cakes from vacuum filtration, centrifugation, or other sludge dewatering processes. A summary of the method includes: sample aliquots of 25-50 g are dried at 103 C to 105 C to drive off water in the sample; the residue from step A is cooled, weighed, and dried again at 550 C to drive off volatile solids in the sample; the total, fixed, and volatile solids are determined by comparing the mass of the sample before and after each drying step. For total solids, the residue left in the vessel after evaporation of liquid from a sample and subsequent drying in an oven at 103 C to 105 C. For volatile solids, the weight loss after a sample is ignited (heated to dryness at 550 C).

To find the volatile solids from total solids:

$$\%\ \text{volatile solids} = \left(\frac{w_{total} - w_{volatile}}{w_{total} - w_{dish}}\right) * 100$$

Where:

$W_{dish}$=Weight of dish $W_{total}$=Weight of dried residue and dish $W_{volatile}$=Weight of residue and dish after ignition Evaporating dishes-Dishes of 100-mL capacity. The dishes may be made of porcelain (90-mm diameter), platinum, or high-silica glass.

As an example of calculating $CO_2$ from volatile solids: Based on tests, 34,800 scf of biogas is generated from each ton of volatile solids destroyed, of which 65% is methane, and 35% is $CO_2$.

$$CO_2\ \text{produced} = \left(12180\ \frac{\text{scf}}{\text{ton}}\ VSD\right) * \left(0.174\ \text{ton}\frac{VS}{\text{ton(biosolids)}}\right) * \left(\frac{VSD}{VS}\right)$$

Where:

VSD=Volatile solids destroyed

VS=Volatile solids

Monitoring, Reporting and Verification

Measurement, Reporting, and Verification (MRV) refers to a process of measuring the quantities of an unwanted material, such as carbon, carbon dioxide, etc., that is eliminated from general dispersal in the environment by subterranean sequestration. The carbon content of the injectable slurry must be measured and reported to an appropriate authority, such as a governmental or non-governmental agency, carbon-credit marketplace, standards association, or the like. The organization verifies or certifies the reported carbon sequestration to issue resulting carbon credits.

MRV proves that the slurry injection process avoided or removed carbon emissions. The quantity of such removal or avoidance is converted into carbon-credits. For example, a single credit can equal one ton of reduced emissions, expressed in tons of CO2 equivalent (tCO2 eq). Carbon credits can be sold, traded, etc., in a national or global marketplace.

Flow Chart

Figure 2:
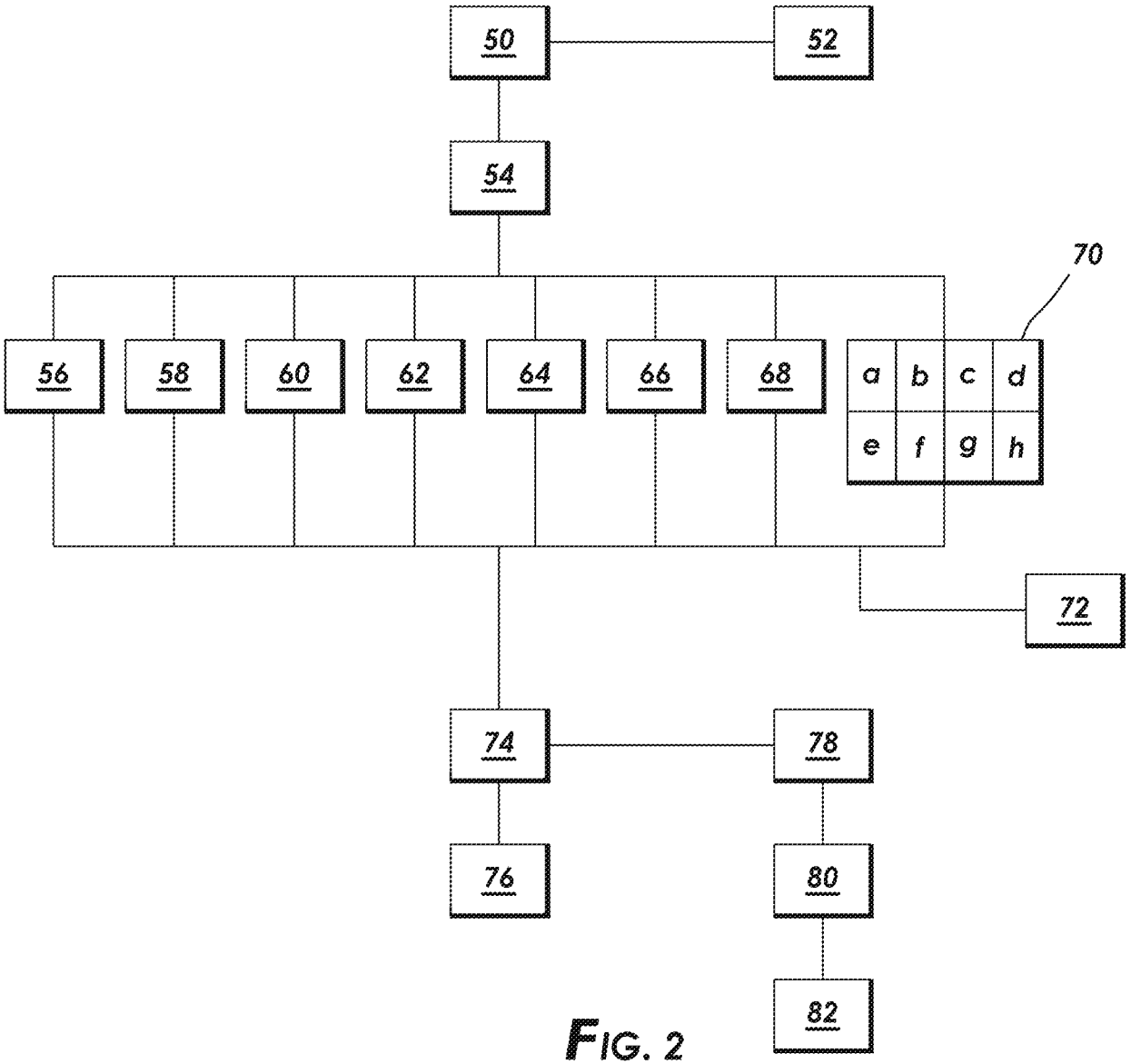
FIG. 2 is an exemplary flow chart of the methods according to aspects of the disclosure.

FIG. 2 is an exemplary flow chart of the methods according to aspects of the disclosure. Persons of skill in the art will recognize changes, additions and deletions of particular steps of the process that can be made depending on the circumstances of the wastes, slurry preparation, injection operations, etc. It is not possible to exhaustively enumerate every possible variation of the steps that can be taken. The methods presented in the claims are explicitly disclosed in this application. Steps can be repeated, as those of skill in the art will understand. Steps can be rearranged, as those of sill in the art will understand.

At block 50, bio-sludge containing material is transported to an injection site, the bio-sludge containing material having a solids content. The transportation can be by any known method. At block 52, the carbon emissions associated with the transporting of the bio-sludge containing material is determined. At block 54, generally the bio-sludge containing material is prepared for injection as an injectate. The preparation process can include several different processes and methods, of which exemplary processes are shown here. The processes are presented in a simplified form in FIG. 2, but it is understood that the processes can occur in various order, certain processes can be repeated, certain processes can be skipped, certain processes can be enhanced, the processes can be performed in various orders. The various combination and permutations are not presented as they will be understood by those of skill in the art.

At block 56, particles of bio-solids of the bio-sludge containing material are degraded, such as by grinding and the like. At block 58, the bio-sludge is processed by mixing or blending with a carrier fluid. The carrier fluid can be an available water supply, HPE, brine, freshwater, saltwater, etc. At block 60, oversized solids particles are removed during the preparation of the injectate. At block 62, the bio-sludge is filtered, ground or otherwise physically altered. At block 64, unsuitable solids are removed from the bio-sludge. At block 66, the fluid, sludge, slurry weight and/or viscosity are altered, such as by the addition of additives, thickening agents, viscous fluids and the like. At block 68, methanotrophic bacteria or other organisms can be added to the sludge. Methanotrophic bacteria can be used to consume or reduce the methane produced in the bio-sludge or slurry due to decomposition of organic matter. At block 70, methods, processes and treatments can be performed on the bio-sludge where it contains mixed-density materials, wherein mixed-density materials comprise those with some solids that will tend to float either in the bio-sludge, injectate, or in a subterranean cavern.

The block 70 includes multiple steps which can be performed in any order, any number of times, with omission or addition of steps. For example, at block 70*a* methods can be performed to promote sinking of light density solids materials. At block 70*b*, the mixed density material is degraded by grinding or milling. At block 70*c*, the mixed density material is treated to break open pores in the mixed density material, such as pores in biochar. At block 70*d*, lower density material broken out of the mixed density material is allowed to escape the material (e.g., as air, CO2, etc.). At block 70*e*, the escaped material is displaced by a fluid, such as saturated brine. At block 70*f*, the escaped lighter material, such as gasses, are captured and can be processed for sequestration. At block 70*g*, the mixed density material is submerged in a weir tank or the like, to separate floating material particles. At block 70*h*, separated floating materials are treated. In some embodiments, instead of a weir tank, a hydro-cyclone, centrifuge or other equipment separates the materials by relative density.

At block 72, the carbon emissions associated with the preparation of the slurry injectate is determined. At block 74, the injectate is injected into a subterranean target sequestration zone. In some embodiments, the injectate is injected into a subterranean cavern where the injectate, in some embodiments, sinks in the brine-filled cavern. In other embodiments, the prepared injectate slurry is injected into a subterranean zone (of rock), and in some embodiments, at block 76, the injectate is injected at above fracture gradient.

At block 78, the carbon associated with the injected injectate is determined. At block 80, carbon emissions losses are determined by tracking and calculating carbon emissions that arise elsewhere as a result of sequestering the bio-sludge materials. At block 82, the net carbon dioxide removal from the environment due to the carbon sequestration is determined.

Claim Support

The disclosure herein can be understood through the following non-limiting examples.

Example 1. A method of carbon sequestration in a subterranean formation having a wellbore extending through a target sequestration zone, the method comprising: transporting bio-sludge containing material to an injection site, the bio-sludge containing material having a solids content; determining the carbon emissions associated with the transporting of the bio-sludge containing material; processing the bio-sludge containing material into a bio-sludge injectate suitable for injection into the target sequestration zone, the processing including size degradation of the solids content and mixing of a carrier fluid with the bio-sludge containing material; determining the carbon emissions associated with processing the bio-sludge containing material into a bio-sludge injectate; injecting the bio-sludge injectate into the target sequestration zone; determining the carbon content of the bio-sludge injectate injected into the target sequestration zone; determining the carbon emission losses associated with injecting the bio-sludge injectate into the target sequestration zone; calculating the net carbon emission removal associated with the transporting bio-sludge containing material, processing the bio-sludge containing material into a bio-sludge injectate, injecting the bio-sludge injectate into the target sequestration zone, and the carbon emission losses.

Example 2. The method of example 1, wherein the target sequestration zone comprises a subterranean cavern; and wherein the bio-sludge containing material includes mixed density bio-solids; and wherein processing the bio-sludge containing material further comprises processing the mixed density bio-solids to promote sinking of the bio-solids in the carrier fluid or in the subterranean open cavern.

Example 3. The method of any previous example, wherein processing the mixed density bio-solids further comprises opening pores in the bio-solids and allowing gasses trapped therein to escape.

Example 4. The method of any previous example, further comprising allowing a liquid to replace the trapped gasses in the pores.

Example 5. The method of any previous example, further comprising separating floating bio-solids from the mixed-density bio-sludge containing materials, processing the separated floating bio-solids thereby creating a non-floating bio-solid, and placing the non-floating bio-solid to the bio-sludge injectate.

Example 6. The method of example 1, further comprising injecting the bio-sludge injectate at a pressure greater than the fracturing gradient of the sequestration zone.

Example 7. The method of example 6, wherein processing the bio-sludge containing material further comprises creating the injectate having a solids content of less than 50% by volume, and with particle sizes of less than 1000 microns.

Example 8. The method of any previous example, wherein the bio-sludge injectate comprises remainder vegetative pulps.

Example 9. The method of any previous example, wherein the bio-sludge injectate comprises spent brewer's grain and brewer's yeast by-products of a brewing process.

Example 10. The method of any previous example, wherein the bio-sludge injectate comprises prokaryotes and eukaryotes, bacteria, fungi, phytoplankton, diatoms, dinoflagellates and similar organisms.

CONCLUSION

The words or terms used herein have their plain, ordinary meaning in the field of this disclosure, except to the extent explicitly and clearly defined in this disclosure or unless the specific context otherwise requires a different meaning. If there is any conflict in the usages of a word or term in this disclosure and one or more patent(s) or other documents that may be incorporated by reference, the definitions that are consistent with this specification should be adopted.

Whenever a numerical range of degree or measurement with a lower limit and an upper limit is disclosed, any number and any range falling within the range is also intended to be specifically disclosed. For example, every range of values (in the form "from a to b," or "from about a to about b," or "from about a to b," "from approximately a to b," and any similar expressions, where "a" and "b" represent numerical values of degree or measurement) is to be understood to set forth every number and range encompassed within the broader range of values.

While the foregoing written description of the disclosure enables one of ordinary skill to make and use the embodiments discussed, those of ordinary skill will understand and appreciate the existence of variations, combinations, and equivalents of the specific embodiments, methods, and examples herein. The disclosure should therefore not be limited by the above described embodiments, methods, and examples. While this disclosure has been described with reference to illustrative embodiments, this description is not intended to be construed in a limiting sense. Various modifications and combinations of the illustrative embodiments as well as other embodiments of the disclosure will be apparent to persons skilled in the art upon reference to the description. It is, therefore, intended that the appended claims encompass any such modifications or embodiments.

The particular embodiments disclosed above are illustrative only, as the present disclosure may be modified and practiced in different but equivalent manners apparent to those skilled in the art having the benefit of the teachings herein. It is, therefore, evident that the particular illustrative embodiments disclosed above may be altered or modified and all such variations are considered within the scope of the present disclosure. The various elements or steps according to the disclosed elements or steps can be combined advantageously or practiced together in various combinations or sub-combinations of elements or sequences of steps to increase the efficiency and benefits that can be obtained from the disclosure. It will be appreciated that one or more of the above embodiments may be combined with one or more of the other embodiments, unless explicitly stated otherwise. Furthermore, no limitations are intended to the details of construction, composition, design, or steps herein shown, other than as described in the claims.

The systems, methods, and apparatus in the embodiments described above are exemplary. Therefore, many details are neither shown nor described. Even though numerous characteristics of the embodiments of the present disclosure have been set forth in the foregoing description, together with details of the structure and function of the present disclosure, the present disclosure is illustrative, such that changes may be made in the detail, especially in matters of shape, size and arrangement of the components within the principles of the present disclosure to the full extent indicated by the broad general meaning of the terms used in the attached claims. The description and drawings of the specific examples above do not point out what an infringement of this patent would be but are to provide at least one explanation of how to make and use the present disclosure. The limits of the embodiments of the present disclosure and the bounds of the patent protection are measured by and defined in the following claims.

The invention claimed is:

1. A method of carbon sequestration in a subterranean formation having a wellbore extending through a target sequestration zone, the method comprising:

transporting bio-sludge containing material to an injection site, the bio-sludge containing material having a solids content;

determining a first carbon emissions associated with the transporting of the bio-sludge containing material;

processing the bio-sludge containing material into a bio-sludge injectate suitable for injection into the target sequestration zone, the processing including size degradation of the solids content and mixing of a carrier liquid with the bio-sludge containing material;

determining a second carbon emissions associated with processing the bio-sludge containing material into a bio-sludge injectate;

injecting the bio-sludge injectate into the target sequestration zone;

determining a third carbon content of the bio-sludge injectate injected into the target sequestration zone;

determining a fourth carbon emission losses associated with injecting the bio-sludge injectate into the target sequestration zone;

calculating a net carbon emission removal associated with the transporting bio-sludge containing material, processing the bio-sludge containing material into a bio-sludge injectate, injecting the bio-sludge injectate into the target sequestration zone, and the carbon emission losses.

2. The method of claim 1, wherein the target sequestration zone comprises a subterranean cavern; and wherein the bio-sludge containing material includes mixed density bio-solids; and wherein processing the bio-sludge containing material further comprises processing the mixed density bio-solids to promote sinking of the bio-solids in the carrier liquid or in the subterranean open cavern.

3. The method of claim 2, at least some of the bio-solids defining pores therein, the pores containing gasses trapped within the pores, and wherein processing the mixed density bio-solids further comprises opening pores in the bio-solids by grinding or milling the bio-solids, and thereby allowing gasses trapped therein to escape.

4. The method of claim 3, further comprising allowing a liquid to replace the trapped gasses in the pores.

5. The method of claim 2, further comprising separating floating bio-solids from the mixed-density bio-sludge containing materials, processing the separated floating bio-solids thereby creating a non-floating bio-solid, and placing the non-floating bio-solid to the bio-sludge injectate.

6. The method of claim 1, further comprising injecting the bio-sludge injectate at a pressure greater than the fracturing gradient of the sequestration zone.

7. The method of claim 6, wherein processing the bio-sludge containing material further comprises creating the injectate having a solids content of between one and 50% by volume, and with particle sizes of between one and 1000 microns.

8. The method of claim 6, wherein the bio-sludge injectate comprises remainder vegetative pulps.

9. The method of claim 6, wherein the bio-sludge injectate comprises spent brewer's grain and brewer's yeast by-products of a brewing process.

10. The method of claim 6, wherein the bio-sludge injectate comprises prokaryotes and eukaryotes, bacteria, fungi, phytoplankton, diatoms, and dinoflagellates.

* * * * *